US010976689B2

(12) United States Patent
Yasukawa et al.

(10) Patent No.: US 10,976,689 B2
(45) Date of Patent: Apr. 13, 2021

(54) INTERMEDIATE TRANSFER MEMBER, METHOD FOR MANUFACTURING INTERMEDIATE TRANSFER MEMBER, AND IMAGE FORMING APPARATUS

(71) Applicant: Konica Minolta Inc., Tokyo (JP)

(72) Inventors: Hiroyuki Yasukawa, Hachioji (JP); Yoshiyasu Matsumoto, Fuchu (JP); Keita Miyazaki, Tachikawa (JP); Akiko Kawamura, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/842,014

(22) Filed: Apr. 7, 2020

(65) Prior Publication Data

US 2020/0333730 A1 Oct. 22, 2020

(30) Foreign Application Priority Data

Apr. 16, 2019 (JP) ..... JP2019-077866

(51) Int. Cl.
*G03G 15/16* (2006.01)
*B41J 2/01* (2006.01)

(52) U.S. Cl.
CPC ..... *G03G 15/162* (2013.01); *B41J 2/01* (2013.01); *G03G 15/161* (2013.01); *B41J 2002/012* (2013.01); *G03G 2215/0116* (2013.01); *G03G 2215/2051* (2013.01)

(58) Field of Classification Search
CPC . G03G 15/162; B41J 2/0057; B41J 2002/012; B41J 2/01
See application file for complete search history.

(56) References Cited

U.S. PATENT DOCUMENTS 6,336,025 B1 * 1/2002 Saeki ..... B29C 33/0033 156/137
2003/0067097 A1 * 4/2003 Yu ..... G03G 5/10 264/345
2004/0072088 A1 * 4/2004 Yu ..... G03G 5/047 430/59.6
2015/0268591 A1 * 9/2015 Fujita ..... G03G 15/161 399/121
2016/0320725 A1 * 11/2016 Yoshida ..... G03G 15/162

FOREIGN PATENT DOCUMENTS

JP 2013-220627 A 10/2013

* cited by examiner

*Primary Examiner* — Carla J Therrien
(74) *Attorney, Agent, or Firm* — Lucas & Mercanti, LLP

(57) ABSTRACT

An intermediate transfer member includes: a base layer; an elastic layer that is disposed on the base layer; and a surface layer that is disposed on the elastic layer, wherein, when a breaking elongation of the surface layer is Ah, and a breaking elongation of the elastic layer is Ad, Ad/Ah=4 to 100 is satisfied, and when a linear expansion coefficient of the surface layer is Bh, and a linear expansion coefficient of the elastic layer is Bd, Bd/Bh=0.8 to 2 is satisfied.

8 Claims, 1 Drawing Sheet

INTERMEDIATE TRANSFER MEMBER, METHOD FOR MANUFACTURING INTERMEDIATE TRANSFER MEMBER, AND IMAGE FORMING APPARATUS

The entire disclosure of Japanese patent Application No. 2019-077866, filed on Apr. 16, 2019, is incorporated herein by reference in its entirety.

BACKGROUND

Technological Field

The present invention relates to an intermediate transfer member, a method for manufacturing the intermediate transfer member, and an image forming apparatus.

Description of the Related Art

As an image forming method, an electrophotographic image forming method using a toner and an inkjet image forming method using an ink (for example, see JP 2013-220627 A) are known.

In an image forming method of the electrophotographic system, for example, a latent image formed on a photoconductor is developed with toner, and the obtained toner image is temporarily held on an intermediate transfer member of an endless belt. The toner image on the intermediate transfer member is transferred onto a recording material such as paper.

The intermediate transfer member used in the image forming method of the electrophotographic system is not heated, so that the temperature does not rise, and it is not necessary to consider the stability of each layer constituting the intermediate transfer member against dimensional change due to temperature change.

In the image forming method of the inkjet system, for example, an ink image is formed by discharging ink onto the intermediate transfer member, and temporarily cured by irradiating ultraviolet rays, and the ink image on the intermediate transfer member is transferred on a recording material such as paper.

In the image forming method of the inkjet system, the ink before the pre-curing on the intermediate transfer member is a small droplet, and thus may penetrate into the intermediate transfer member.

In addition, an intermediate transfer member having a precoat layer on the outermost surface is known. In a case where an intermediate transfer member having a precoat layer is used, heat due to ultraviolet irradiation is absorbed by the precoat layer, so that the intermediate transfer member itself is not heated.

In the image forming method of the inkjet system, the configuration of the apparatus may be simplified by eliminating the precoat layer of the intermediate transfer member. In this case, since the ultraviolet rays directly hit the intermediate transfer member, the temperature of the intermediate transfer member itself sometimes changed.

In addition, the surface layer of the intermediate transfer member used in the inkjet system is different from the surface layer of the intermediate transfer member used in the electrophotographic system, and needs a function of preventing the penetration of ink. In addition, the surface layer has a tensile elongation close to that of the elastic layer in order to follow the uneven paper, and if a soft layer is used, the ink may permeate.

SUMMARY

Therefore, an object of the invention is to provide an intermediate transfer member that can prevent ink penetration while maintaining the ink transfer rate even by a heat cycle. In addition, another object of the invention is to provide a method for manufacturing the intermediate transfer member. In addition, another object of the invention is to provide an image forming apparatus having the intermediate transfer member.

To achieve at least one of the abovementioned objects, according to an aspect of the present invention, an intermediate transfer member reflecting one aspect of the present invention comprises: a base layer; an elastic layer that is disposed on the base layer; and a surface layer that is disposed on the elastic layer, wherein, when a breaking elongation of the surface layer is Ah, and a breaking elongation of the elastic layer is Ad, Ad/Ah=4 to 100 is satisfied, and when a linear expansion coefficient of the surface layer is Bh, and a linear expansion coefficient of the elastic layer is Bd, Bd/Bh=0.8 to 2 is satisfied.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1A:
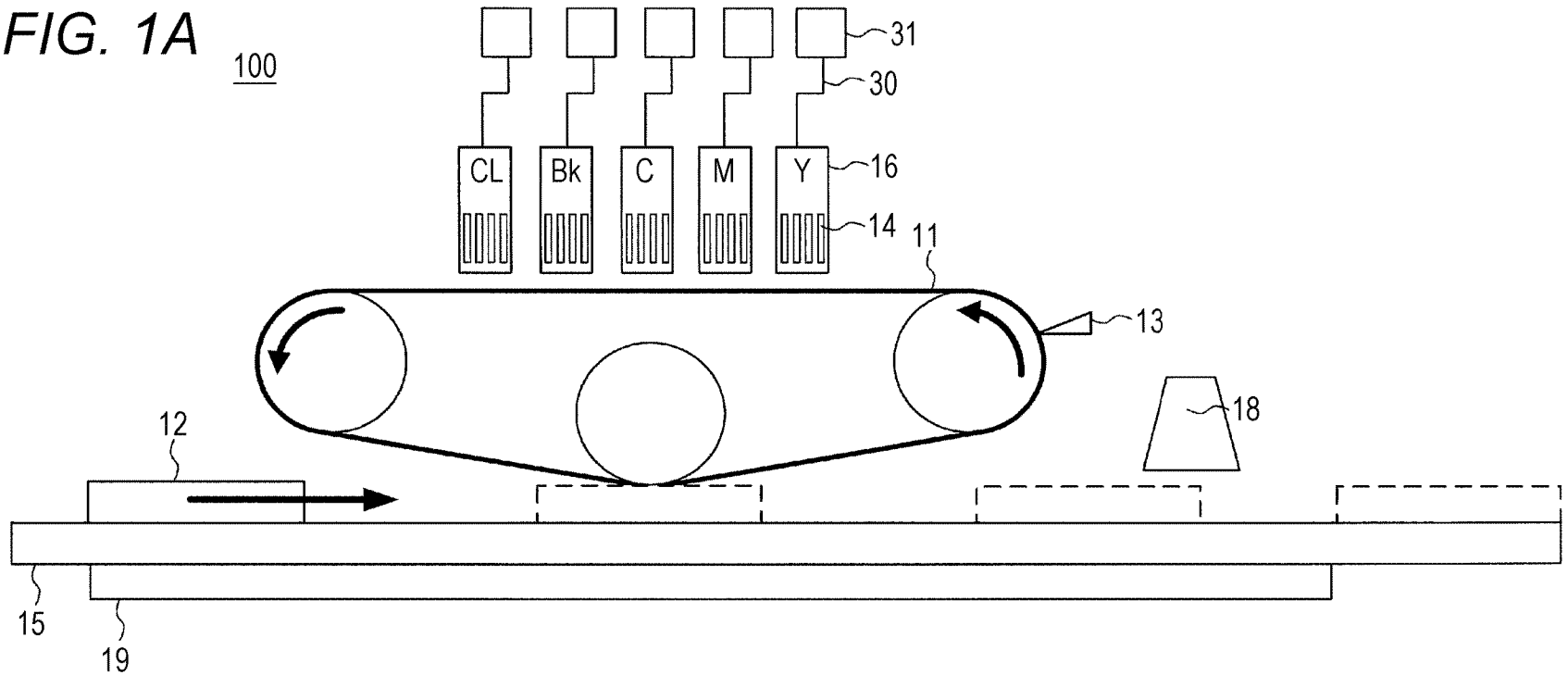
FIGS. 1A and 1B are diagrams illustrating a configuration of an image forming apparatus according to an embodiment of the invention.

Hereinafter, one or more embodiments of the present invention will be described with reference to the drawings. However, the scope of the invention is not limited to the disclosed embodiments.

(Configuration of Intermediate Transfer Member)

The intermediate transfer member according to this embodiment has a base layer, an elastic layer disposed on the base layer, and a surface layer disposed on the elastic layer. The shape of the intermediate transfer member is not particularly limited. The shape of the intermediate transfer member may be an endless belt shape, a stamp shape, or a drum shape. In this embodiment, the intermediate transfer member has an endless belt shape.

The material of the base layer is appropriately selected in consideration of the shape and strength of the intermediate transfer medium. Examples of the material of the base layer in the drum-shaped intermediate transfer member include metals such as iron, stainless steel, and aluminum. Examples of the material of the base layer in the endless belt-shaped intermediate transfer member include resins such as polyimide (PI), polyphenylene sulfide (PPS), polyether sulfone (PES), polyamide (PA), polyethylene terephthalate (PET), polyimide amide (PIA), polytetrafluoroethylene (PTFE), tetrafluoroethylene-perfluoroalkyl vinyl ether copolymer (PFA), tetrafluoroethylene-hexafluoropropylene copolymer (FEP); ethylene propylene rubber (EPDM), elastomers such as silicone rubber and fluorine rubber. The material of the base layer is preferably PI or PA from the viewpoint of strength and toughness.

The thickness of the base layer is preferably from 50 to 100 μm, for example, 70 μm, from the viewpoint of exhibiting a desired function. The thickness of the base layer can be determined, for example, as a measured value obtained from a cross section when the intermediate transfer member is cut in the stacking direction or an average value thereof.

The elastic layer is disposed between the base layer and the surface layer. A breaking elongation Ad of the elastic layer is 200 to 1000%, preferably 500 to 800%. In addition, a linear expansion coefficient Bd of the elastic layer is $250\times10^{-6}$ to $450\times10^{-6}$ (1/° C.), and preferably $250\times10^{-6}$ to $350\times10^{-6}$ (1/° C.).

In order to obtain the elastic layer having a breaking elongation and a linear expansion coefficient within a predetermined range, a material having a hardness of 10 to 40 as measured by a type A durometer may be used. Examples of the material of the elastic layer having the hardness include silicone rubber, nitrile rubber, urethane rubber, chloroprene rubber, and epichlorohydrin rubber. The material of the elastic layer is preferably silicone rubber from the viewpoint of the penetration of the ink into the intermediate transfer member and the deterioration due to ultraviolet irradiation.

The thickness of the elastic layer is preferably 100 to 1000 μm, for example, 300 μm, from the viewpoint of exhibiting a desired function. The thickness of the elastic layer can be determined, for example, as a measured value obtained from a cross section when the intermediate transfer member is cut in the stacking direction or an average value thereof.

The surface layer is disposed on the elastic layer. The surface layer is preferably a layer having releasability from the ink. The breaking elongation Ah of the surface layer is 10 to 50%, preferably 20 to 50%. In addition, the linear expansion coefficient Bh of the surface layer is $200\times10^{-6}$ to $500\times10^{-6}$ (1/° C.), and preferably $200\times10^{-6}$ to $400\times10^{-6}$ (1/° C.). If the linear expansion coefficient of the surface layer is too small, the surface layer may crack. On the other hand, if the linear expansion coefficient of the surface layer is too large, the intermolecular distance becomes long, so that ink may permeate the surface layer.

The surface layer has a polymer obtained by curing a first monomer and a second monomer with a curing agent.

Examples of the first monomer include a perfluorovinyl monomer, a trifluorovinyl monomer, a difluorovinyl monomer, and a monofluorovinyl monomer. As the first monomer, one type may be used alone, or two or more types may be used in combination. The content of the first monomer in the surface layer is preferably 40 mol % or more and less than 70 mol %. When the content of the first monomer in the surface layer is too small, the linear expansion coefficient may be too small. On the other hand, in a case where the content of the first monomer in the surface layer is too large, the content of the second monomer is relatively small, and the durability of the surface layer may be reduced due to a decrease in the number of crosslinking points.

Examples of the second monomer include a vinyl ether monomer, a vinyl alkoxy monomer, and a vinyl alkyl monomer. As the second monomer, one type may be used alone, or two or more types may be used in combination.

The curing agent cures the first monomer and the second monomer. The type of the curing agent is not particularly limited as long as the above function can be exhibited. Examples of the curing agent include an isocyanate curing agent, an epoxy curing agent, and an amine curing agent. Examples of the isocyanate curing agent include an alkyl isocyanate, an alkoxy isocyanate, and a phenoxy isocyanate. The content of the curing agent in the surface layer is preferably 15 parts or more and less than 25 parts. In a case where the content of the curing agent in the surface layer is too small, the linear expansion coefficient increases, but the number of crosslinking points decreases, and the durability may decrease. On the other hand, in a case where the content of the curing agent in the surface layer is too large, the linear expansion coefficient becomes too small, and the surface layer is easily broken.

Examples of a polymer in which such a monomer is cured include polytetrafluoroethylene (PTFE), tetrafluoroethylene-perfluoroalkylvinyl ether copolymer (PFA), and tetrafluoroethylene-hexafluoropropylene copolymer (FEP).

The thickness of the surface layer is preferably from 5 to 30 μm, more preferably from 10 to 20 μm.

The presence of the first monomer in the surface layer of the intermediate transfer member can be determined by quantifying fluorine atoms by an ion chromatography method.

Here, the relationship between the elastic layer and the surface layer will be described. The intermediate transfer member satisfies Ad/Ah=4 to 100 and preferably satisfies Ad/Ah=5 to 20, when the breaking elongation of the surface layer is Ah and the breaking elongation of the elastic layer is Ad. In a case where Ad/Ah is too small, the transfer rate to the recording medium will decrease. On the other hand, in a case where Ad/Ah is too large, the elongation of the elastic layer is large and the surface layer is broken. In other words, when the elastic layer and the surface layer are within the above range, cracking of the surface layer and peeling of the interface between the elastic layer and the surface layer can be prevented.

The breaking elongation is determined, for example, by the following method. The breaking elongation can be determined by a tensile test using a section cut out into a dumbbell shape in accordance with JIS K 6251 or JIS K 7161. The section cut out from the dumbbell No. 1 is pulled using an Autograph AGS-X (manufactured by Shimadzu Corporation) at a distance between chucks of 130 mm and a tensile speed of 10 mm/min, and a broken portion can be obtained as a breaking elongation.

The intermediate transfer member satisfies Bd/Bh=0.8 to 2.0 and preferably satisfies Bd/Bh=0.8 to 1.5, where Bh is the linear expansion coefficient of the surface layer and Bd is the linear expansion coefficient of the elastic layer. When Bd/Bh is too small, the transferability to a recording medium is reduced. On the other hand, in a case where Bd/Bh is too large, the interface will peel off during the durable operation.

The linear expansion coefficient is obtained, for example, by the following method. First, a section of 15 mm×5 mm×0.8 mm is cut out, and heated up from 0 to 120° C., kept 10 minutes, cooled down from 120 to 0° C., kept 10 minutes, warmed up from 0 to 120° C., kept 10 minutes, cooled down from 120 to 0° C., and measured distortion using a thermomechanical analyzer TMA-7100 (manufactured by Hitachi High-Technologies Corporation) at a distance between chucks of 5 mm and a heating rate of 5° C./min. Then, a graph illustrating the relationship between the temperature and the amount of strain is written, and the slope of the straight line corresponding to the heating at 50 to 100° C. at the second temperature rise can be measured as the linear expansion coefficient.

The breaking elongation and the linear expansion coefficient can be measured using a sample in which each layer has been peeled off from the intermediate transfer member.

When the breaking elongation and the linear expansion coefficient are within the above ranges, it is possible to prevent a decrease in the ink transfer rate due to a local temperature change by ultraviolet rays or the like and also to prevent the penetration of the ink.

(Method for Manufacturing Intermediate Transfer Member)

The method for manufacturing an intermediate transfer member according to this embodiment includes a step of applying a composition containing a perfluorovinyl monomer or a trifluorovinyl monomer, a vinyl ether monomer, and an isocyanate curing agent onto the elastic layer, and curing the composition to form the surface layer.

Specifically, the method includes a step of preparing the base layer, a step of forming the elastic layer, and a step of forming the surface layer.

The base layer can be manufactured by a conventionally known general method. For example, the base layer can be manufactured by melting a heat-resistant resin as a material with an extruder, forming it into a tubular shape by the inflation method using a ring die, and then cutting it into a ring (endless belt shape).

The elastic layer can also be manufactured by a conventionally known general method. For example, the elastic layer can be formed by applying and curing a molten resin such as silicone rubber as a material on the base layer to be a dry film having a thickness of 100 to 1000 μm.

In the step of forming the surface layer, a composition containing a first monomer such as a perfluorovinyl monomer or a trifluorovinyl monomer, a second monomer such as a vinyl ether monomer, and a curing agent such as an isocyanate curing agent is applied and dried on the elastic layer so as to be a coating film having a thickness of 1 to 100 μm. By curing this coating film, the surface layer made of a polymer can be formed.

As a method for applying the composition, known methods such as a dip coating method, a spray coating method, a spinner coating method, a bead coating method, a blade coating method, a beam coating method, and a slide hopper method can be employed.

When the breaking elongation of the surface layer of the manufactured intermediate transfer member is Ah and the breaking elongation of the elastic layer is Ad, Ad/Ah=4 to 100 is satisfied. When the linear expansion coefficient of the surface layer is Bh, and the linear expansion coefficient of the elastic layer is Bd, Bd/Bh=0.8 to 2.0 is satisfied.

In addition, the surface layer produced by applying the composition in this way cannot have a large breaking elongation as compared with the surface layer having a film for the surface layer attached thereto. However, when trying to achieve the function of preventing the ink from penetrating into the surface layer by eliminating cracks in the surface layer, the surface layer having a small breaking elongation can be an intermediate transfer member free of cracks and peeling following the elastic layer by making the breaking elongation approach the linear expansion coefficient of the elastic layer.

(Configuration of Image Forming Apparatus)

Figure 1B:
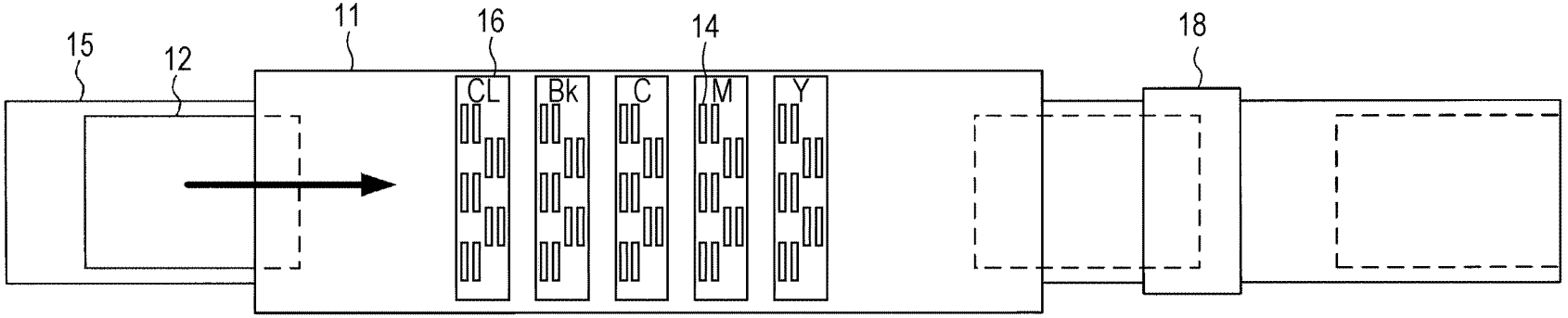

The image forming method of the invention using the intermediate transfer member can be performed, for example, using an image forming apparatus of an actinic ray curing type inkjet method. FIGS. 1A and 1B are diagrams illustrating a configuration of an image forming apparatus 100 of the inkjet system. FIG. 1A is a side view of an inkjet type image forming apparatus 100 according to a first embodiment of the invention, and FIG. 1B is a plan view.

As illustrated in FIGS. 1A and 1B, the image forming apparatus 100 of the inkjet system includes a head carriage 16 accommodating a plurality of inkjet heads 14, an ink flow path 30 connected to the head carriage 16, the ink tank 31 that stores ink to be transferred through the ink flow path 30, an intermediate transfer member (intermediate transfer belt) 11 that receives ink ejected from the inkjet head 14 and transfers the ink to a recording medium 12, a transport member 15 that transports the recording medium 12, the light irradiation unit 18 that is disposed downstream of the intermediate transfer member 11 (in the conveyance direction of the recording medium), and a temperature control unit 19 disposed on the lower surface of the recording medium 12. Further, a cleaning member 13 is disposed downstream of the intermediate transfer member 11 (in the conveyance direction of the recording medium).

The recording medium 12 is not particularly limited. Examples of the recording medium 12 include plain paper from thin paper to thick paper, high-quality paper, coated printing paper such as art paper or coated paper, commercially available Japanese paper and postcard paper, plastic films for OHP, and cloth.

The head carriage 16 is fixed so as to cover the entire width of the intermediate transfer member 11 and stores the plurality of inkjet heads 14. The ink is supplied to the inkjet head 14. For example, ink may be supplied from an ink cartridge or the like (not illustrated) removably attached to the image forming apparatus 100 or by an ink supply unit (not illustrated). As the ink, for example, an actinic ray-curable inkjet ink can be used.

The plurality of inkjet heads 14 are arranged in the conveyance direction of the recording medium 12 for each color. The number of the inkjet heads 14 arranged in the conveyance direction of the recording medium 12 is set according to the nozzle density of the inkjet head 14 and the resolution of a print image. For example, in a case where an image having a resolution of 1440 dpi is formed using the inkjet head 14 having a droplet amount of 2 pL and a nozzle density of 360 dpi, the four inkjet heads 14 may be displaced to be shifted with respect to the conveyance direction of the recording medium 12. In addition, in a case where an image having a resolution of 720×720 dpi is formed using the inkjet head 14 having a droplet amount of 6 pL and a nozzle density of 360 dpi, the two inkjet heads 14 may be displaced to be shifted. The dpi represents the number of ink droplets (dots) per 2.54 cm.

The ink tank 31 is connected to the head carriage 16 via the ink flow path 30. The ink flow path 30 is a path for supplying the ink in the ink tank 31 to the head carriage 16. In order to stably eject the ink droplets, the ink in the ink tank 31, the ink flow path 30, the head carriage 16, and the inkjet head 14 are heated to a predetermined temperature.

The intermediate transfer member 11 is disposed between the head carriage 16 and the recording medium 12. The intermediate transfer member 11 has a base layer, an elastic layer, and a surface layer. After the ink has landed, the intermediate transfer member 11 is transported in a certain direction (the direction indicated by the arrow in FIGS. 1A and 1B) and is pressed against the recording medium 12. At this time, a predetermined pressure (nip pressure) is applied between the recording medium 12 and the ink landing surface. Adjustment of the nip pressure is performed by adjusting the distance between the recording medium 12 and the intermediate transfer member 11. A temperature control unit (not illustrated) for the intermediate transfer belt for adjusting the temperature of the intermediate transfer member 11 at the time of ink landing is provided inside or outside the intermediate transfer member 11. The temperature control unit for the intermediate transfer belt is, for example, various heaters.

The transport member 15 is arranged to convey the recording medium 12 to the intermediate transfer member 11 and the light irradiation unit 18 at a constant speed. On the lower surface of the transport member 15, the temperature control unit 19 is arranged. The temperature control unit 19 maintains the temperature of the recording medium 12 at a predetermined temperature. The temperature control unit 19 is, for example, various heaters.

The light irradiation unit 18 covers the entire width of the recording medium 12 and is disposed downstream of the intermediate transfer member 11 in the conveyance direction of the recording medium 12. The light irradiation unit 18 irradiates the ink droplet transferred onto the recording medium 12 with light to cure the droplet.

The cleaning member 13 is disposed downstream of the intermediate transfer member 11 (the conveyance direction of the recording medium), and wipes off a transfer residue (actinic ray-curable inkjet ink) attached to the surface of the intermediate transfer member 11 with a blade or the like. The cleaning member 13 is usually provided with a collecting section (not illustrated) for collecting transfer residues. The member for wiping and removing the transfer residue is not limited to the blade, and includes, for example, a brush roll, an air knife, and an adhesive roll.

First, the recording medium 12 is transported between the transport member 15 of the image forming apparatus 100 and the intermediate transfer member 11. At this time, the temperature of the recording medium 12 is adjusted by the temperature control unit 19. On the other hand, high-temperature ink droplets are ejected from the inkjet head 14 of the head carriage 16 and adhere (land) on the intermediate transfer member 11. After the completion of the ejection of the ink droplets, the ink landed surface of the intermediate transfer member 11 is rotated in a certain direction (the direction illustrated by an arrow in FIGS. 1A and 1B). Then, the recording medium 12 and the intermediate transfer member 11 are pressed, and the ink droplets on the intermediate transfer member 11 are transferred to the recording medium 12. The recording medium 12 is moved to the light irradiation unit 18 side, and the ink droplets adhered on the recording medium 12 are irradiated with light to be cured. The transfer residue adhering to the intermediate transfer member 11 is wiped off by the cleaning member 13.

EXAMPLE

The invention will be specifically described with reference to the following examples and comparative examples. However, the technical scope of the invention is not limited only to the following examples.

<Preparation of Intermediate Transfer Member (Intermediate Transfer Belt)>

[Preparation of Intermediate Transfer Belt 1]

(Preparation of Base Layer)

While rotating the stainless steel cylindrical mold around the axis of the cylinder, the base layer varnish is discharged from the nozzle (UPILEX (registered trademark)-S (Ube Industries) varnish) and applied spirally on the outer peripheral surface of the mold while moving a dispense nozzle in the axial direction, and a coating film covering the outer peripheral surface is formed integrally with the base layer varnish. Next, the coating is heated at 100° C. for 1 hour while rotating the cylindrical mold to volatilize most of the solvent in the coating film, and then heated at 250° C. for 1 hour. Thus, an endless belt-like base layer having a thickness of 70 μm is produced.

(Preparation of Elastic Layer)

An elastic layer material is prepared by kneading 100 parts by mass of silicone rubber (KE-1204A; manufactured by Shin-Etsu Astec Co., Ltd.) and 100 parts by mass of silicone rubber (KE-1204B; manufactured by Shin-Etsu Astec Co., Ltd.). The elastic layer material is dissolved and dispersed in toluene so as to have a solid concentration of 80% by mass to prepare a coating liquid for forming an elastic layer.

The coating liquid for forming the elastic layer is applied on the endless belt-shaped base layer to form a coating film covering the outer peripheral surface of the base layer. Then, the cylindrical mold is heated at 50° C. for 1 hour while rotating to volatilize most of the solvent, and then heated to 150° C. and held for 30 minutes for crosslinking to form the elastic layer. The thickness of the formed elastic layer is 300 μm.

The breaking elongation of the elastic layer measured by the following method is 300%. The breaking elongation of the elastic layer is obtained by a tensile test using a section cut out into a dumbbell shape. The section cut out from the dumbbell No. 1 is pulled using an Autograph AGS-X (manufactured by Shimadzu Corporation) at a distance between chucks of 130 mm and a tensile speed of 10 mm/min, and a broken portion is obtained as a breaking elongation.

When the linear expansion coefficient of the elastic layer is measured by the following method, $270\times10^{-6}$ (1/° C.) is obtained. The linear expansion coefficient of the elastic layer is measured such that a section of 15 mm×5 mm×0.8 mm is prepared, and heated up from 0° C. to 120° C., kept 10 minutes, cooled down from 120° C. to 0° C., kept 10 minutes, warmed up from 0° C. to 120° C., kept 10 minutes, cooled down from 120° C. to 0° C., and measured distortion using a thermomechanical analyzer TMA-7100 (manufactured by Hitachi High-Technologies Corporation) at a distance between chucks of 5 mm and a heating rate of 5° C./min. Then, a graph illustrating the relationship between the temperature and the amount of strain is written, and the slope of the heating at 50° C. to 100° C. at the second temperature rise can be measured as the linear expansion coefficient.

(Preparation of Surface Layer)

On the outer peripheral surface of the prepared elastic layer, a coating solution for forming the surface layer (KR-282; manufactured by Shin-Etsu Silicone Co., Ltd.) is applied by a spiral coating method to form a dry film with a thickness of 10 μm, and a coating film is formed. While rotating the cylindrical mold made of stainless steel around the axis of the cylinder, the coating liquid for forming the surface layer is discharged from the nozzle to form a spiral on the outer peripheral surface of the mold while moving the dispense nozzle in the axial direction, and a coating solution for covering the outer peripheral surface is formed on the outer peripheral surface by integrally applying the surface layer forming coating liquid. Next, the coating is heated at 100° C. for 1 hour while rotating the cylindrical mold to volatilize most of the solvent in the coating film, and then heated at 150° C. for 1 hour. Thus, an intermediate transfer belt 1 having an endless belt-like surface layer having a thickness of 10 μm is prepared. Further, KR-282 corresponds to the above-mentioned second monomer.

When the breaking elongation of the surface layer is measured in the same manner as the breaking elongation of the elastic layer, 4% is obtained. When the linear expansion coefficient of the surface layer is measured in the same mariner as the linear expansion coefficient of the elastic layer, 200 (1/° C.) is obtained.

[Preparation of Intermediate Transfer Belt 2]

An intermediate transfer belt 2 is prepared in the same manner as the intermediate transfer belt 1 except that SS0054 (manufactured by AGC Coat-tech) is used as the coating solution for forming the surface layer. SS0054 is a mixture of the above-described first monomer, second monomer, curing agent, and additive.

[Preparation of Intermediate Transfer Belt 3]

An intermediate transfer belt 3 is prepared in the same manner as the intermediate transfer belt 2 except that SS0051 (manufactured by AGC Coat-tech) is used as the coating solution for forming the surface layer. Further, SS0051 is a mixture of the above-described first monomer, second monomer, and curing agent.

[Preparation of Intermediate Transfer Belt 4]

As a coating solution for forming the surface layer, an intermediate transfer belt 4 is prepared in the same manner as the intermediate transfer belt 1 except that a mixture of SS0054 (manufactured by AGC Coat-tech) and CHEMINOX FAAC-4 (manufactured by Unimatec) are used. Further, CHEMINOX FAAC-4 corresponds to the perfluorovinyl monomer as the first monomer.

[Preparation of Intermediate Transfer Belt 5]

As a coating solution for forming the surface layer, an intermediate transfer belt 5 is prepared in the same manner as the intermediate transfer belt 1 except that a mixture of SS0051 (manufactured by AGC Coat-tech) and CHEMINOX FAAC-4 (manufactured by Unimatec) are used.

[Preparation of Intermediate Transfer Belt 6]

As a coating solution for forming the surface layer, an intermediate transfer belt 6 is prepared in the same manner as the intermediate transfer belt 1 except that a mixture of SS0051 (manufactured by AGC Coat-tech) and CHEMINOX FAAC-4 (manufactured by Unimatec) are used.

[Preparation of Comparative Intermediate Transfer Belt 1]

A comparative intermediate transfer belt 1 is prepared in the same manner as intermediate transfer belt 1 except that KR-311 (manufactured by Shin-Etsu Silicone Co., Ltd.) is used as the resin for the surface layer.

[Preparation of Comparative Intermediate Transfer Belt 2]

A comparative intermediate transfer belt 2 is prepared in the same manner as intermediate transfer belt 1 except that KR-5206 (manufactured by Shin-Etsu Silicone Co., Ltd.) is used as the resin for the surface layer.

[Preparation of Comparative Intermediate Transfer Belt 3]

A comparative intermediate transfer belt 3 is prepared in the same manner as intermediate transfer belt 1 except that KR-242 (manufactured by Shin-Etsu Silicone Co., Ltd.) is used as the resin for the surface layer.

Table 1 illustrates the intermediate transfer belt No. and each parameter.

TABLE 1

| | | Surface layer | | Elastic layer | | | | First | |
|---|---|---|---|---|---|---|---|---|---|
| | Intermediate transfer belt No. | Breaking elongation Ah (%) | Linear expansion coefficient Bh (1/° C.) | Breaking elongation Ah (%) | Linear expansion coefficient Bh (1/° C.) | Ad/Ah | Bd/Bh | monomer Second monomer (mol %) | Curing agent (part) |
| Example 1 | 1 | 4 | 200 | 300 | 270 | 75 | 1.35 | 0 | 0 |
| Example 2 | 2 | 20 | 240 | 300 | 270 | 15 | 1.13 | 50 | 23 |
| Example 3 | 3 | 43 | 280 | 300 | 270 | 6.98 | 0.96 | 50 | 20 |
| Example 4 | 4 | 25 | 350 | 280 | 350 | 11.2 | 1.00 | 60 | 23 |
| Example 5 | 5 | 48 | 430 | 280 | 350 | 5.83 | 0.81 | 60 | 20 |
| Example 6 | 6 | 45 | 380 | 280 | 350 | 6.22 | 0.92 | 60 | 25 |
| Comparative Example 1 | 7 | 2 | 110 | 300 | 270 | 150 | 2.45 | 0 | 0 |
| Comparative Example 2 | 8 | 200 | 400 | 300 | 270 | 1.5 | 0.68 | 0 | 0 |
| Comparative Example 3 | 9 | 3 | 130 | 300 | 270 | 100 | 2.08 | 0 | 0 |

[Evaluation of Penetration Rate]

The ink penetration rate is evaluated by the following method. Ink is dropped on the surface layer of each intermediate transfer belt, and the weight of the intermediate transfer belt is measured. After being left for 30 minutes, the ink on the surface layer is wiped off, and the weight of the intermediate transfer belt is measured again. The difference between the weights of the intermediate transfer belt before and after being left is defined as the weight of the ink permeated into the intermediate transfer belt. The ink penetration is calculated from the weight of the ink dropped on the intermediate transfer belt and the weight of the permeated ink. If the penetration rate is 1% or less, it is regarded as acceptable.

[Evaluation of Transfer Rate]

The transfer rate is evaluated by the following method. For the evaluation of the transfer rate, the intermediate transfer belt before and after the durability test is used. Each of the intermediate transfer belts after the transfer step is observed with an optical microscope, and the remaining area ratio of the ink on the intermediate transfer belt is defined as a transfer rate. The transfer rate when all the ink is transferred to the recording medium and no ink remained on the intermediate transfer belt is defined as 100%. The endurance test is conducted at a distance of 20 mm from a light source (GC113; manufactured by Hamamatsu Photonics) capable of irradiating ultraviolet rays having a wavelength of 395 nm at an intensity of 4 W/cm$^2$ for 16 hours (repeated irradiation for 2 seconds and stopping irradiation for 2 seconds). If the transfer rate is 75% or more, it is determined to be acceptable.

Table 2 illustrates the evaluation results of the penetration rate and the transfer rate.

TABLE 2

| | Intermediate transfer belt No. | Penetration Rate (%) | Transfer Rate (%) | |
|---|---|---|---|---|
| | | | Before durability test | After durability test |
| Example 1 | Intermediate transfer belt 1 | 0.4 | 95 | 93 |
| Example 2 | Intermediate transfer belt 2 | 0.24 | 93 | 90 |
| Example 3 | Intermediate transfer belt 3 | 0.05 | 89 | 85 |
| Example 4 | Intermediate transfer belt 4 | 0.15 | 91 | 88 |
| Example 5 | Intermediate transfer belt 5 | 0.01 | 87 | 84 |
| Example 6 | Intermediate transfer belt 6 | 0.007 | 85 | 82 |
| Comparative Example 1 | Comparative intermediate transfer belt 1 | 2 | 70 | Surface Crack |
| Comparative Example 2 | Comparative intermediate transfer belt 2 | 10 | 65 | 14 |
| Comparative Example 3 | Comparative intermediate transfer belt 3 | 5 | 88 | Surface Crack |

As illustrated in Table 2, in the intermediate transfer belts 1 to 6 where Ad/Ah=4 to 100 and Bd/Bh=0.8 to 2, both the penetration rate and the transfer rate are sufficient. On the other hand, in the comparative intermediate transfer belts 1 to 3, which do not satisfy Ad/Ah=4 to 100 and Bd/Bh=0.8 to 2, both the penetration rate and the transfer rate are insufficient.

According to the invention, it is possible to prevent a decrease in transfer rate due to deterioration of durability of the intermediate transfer member. Therefore, according to the invention, higher quality of the formed image is expected.

Although embodiments of the present invention have been described and illustrated in detail, the disclosed embodiments are made for purposes of illustration and example only and not limitation. The scope of the present invention should be interpreted by terms of the appended claims.

What is claimed is:

1. An intermediate transfer member comprising: a base layer; an elastic layer that is disposed on the base layer; and a surface layer that is disposed on the elastic layer, wherein, when a breaking elongation of the surface layer is Ah, and a breaking elongation of the elastic layer is Ad, Ad/Ah=4 to 100 is satisfied, and when a linear expansion coefficient of the surface layer is Bh, and a linear expansion coefficient of the elastic layer is Bd, Bd/Bh=0.8 to 2 is satisfied.

2. The intermediate transfer member according to claim 1, wherein the linear expansion coefficient Bh of the surface layer is $200\times10^{-6}$ to $500\times10^{-6}$ 1/° C.

3. The intermediate transfer member according to claim 1, wherein the surface layer is a polymer obtained by curing a perfluorovinyl monomer or a trifluorovinyl monomer, and a vinyl ether monomer with an isocyanate curing agent.

4. The intermediate transfer member according to claim 3, wherein a content of the perfluorovinyl monomer or the trifluorovinyl monomer in the surface layer is 40 mol % or more and less than 70 mol %.

5. The intermediate transfer member according to claim 3, wherein the isocyanate curing agent is an alkyl isocyanate, and a content of the alkyl isocyanate is 15 parts or more and less than 25 parts.

6. The intermediate transfer member according to claim 1, wherein the elastic layer is made of silicone rubber.

7. The intermediate transfer member according to claim 1, wherein a shape of the intermediate transfer member is an endless belt.

8. An image forming apparatus comprising the intermediate transfer member according to claim 1.

* * * * *